US010974288B1

(12) United States Patent
Georgatos

(10) Patent No.: US 10,974,288 B1
(45) Date of Patent: Apr. 13, 2021

(54) WALL-CLIMBING PRESSURE WASHING TOOL

(71) Applicant: Kirikos Georgatos, Jackson, NJ (US)

(72) Inventor: Kirikos Georgatos, Jackson, NJ (US)

( * ) Notice: Subject to any disclaimer, the term of this patent is extended or adjusted under 35 U.S.C. 154(b) by 93 days.

(21) Appl. No.: 16/223,325

(22) Filed: Dec. 18, 2018

(51) Int. Cl.

| | |
|---|---|
| ***B08B 3/02*** | (2006.01) |
| ***B08B 1/00*** | (2006.01) |
| ***A46B 13/06*** | (2006.01) |
| ***A46B 11/06*** | (2006.01) |

(52) U.S. Cl.
CPC ..... *B08B 3/024* (2013.01); *A46B 11/06* (2013.01); *A46B 13/06* (2013.01); *B08B 1/002* (2013.01); *B08B 1/008* (2013.01)

(58) Field of Classification Search
None
See application file for complete search history.

(56) References Cited

U.S. PATENT DOCUMENTS

| | | | | |
|---|---|---|---|---|
| 5,135,015 | A | 8/1992 | Young | |
| 6,158,678 | A * | 12/2000 | Lange | A47L 11/38 239/532 |
| 6,302,967 | B1 | 10/2001 | Rohrbacher | |
| 6,929,198 | B2 | 8/2005 | Dexter | |
| D544,656 | S | 6/2007 | Bloch | |
| 7,624,933 | B2 * | 12/2009 | Boekelman | B08B 3/026 239/569 |
| 7,891,036 | B2 | 2/2011 | Hahn | |
| 8,118,241 | B2 | 2/2012 | Gardner | |
| 2003/0062430 | A1 | 4/2003 | Cook | |
| 2006/0118656 | A1 * | 6/2006 | Griffith | B08B 1/00 239/280 |

FOREIGN PATENT DOCUMENTS

| | | |
|---|---|---|
| EP | 1710024 | 12/2006 |

* cited by examiner

*Primary Examiner* — Michael E Barr
*Assistant Examiner* — Jason P Riggleman
(74) *Attorney, Agent, or Firm* — Kyle A. Fletcher, Esq.

(57) ABSTRACT

The wall-climbing pressure washing tool is configured for use in washing a wall. The wall-climbing pressure washing tool transports a liquid under pressure to the wall. The wall-climbing pressure washing tool diverts a portion of the received liquid to generate a motive force that moves the wall-climbing pressure washing tool along the wall. The wall-climbing pressure washing tool comprises a pressure head and a telescopic handle. The pressure head is the working element of the wall-climbing pressure washing tool. The pressure head diverts a portion of the liquid to a motive device that moves the pressure head along the wall. The pressure head transports the balance of the liquid to the wall. The telescopic handle manipulates the wall-climbing pressure washing tool. The span of the length of the telescopic handle adjusts as the pressure head moves along the wall.

17 Claims, 3 Drawing Sheets

WALL-CLIMBING PRESSURE WASHING TOOL

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of performing operations including cleaning by methods involving the use of liquid streams, more specifically, a device configured to clean by moving spray elements over a surface. (B08B3/24)

SUMMARY OF INVENTION

The wall-climbing pressure washing tool is a hand tool. The wall-climbing pressure washing tool is a pressure washing device. The wall-climbing pressure washing tool is configured for use with a vertical surface. The wall-climbing pressure washing tool transports a liquid received under pressure to the vertical surface. The wall-climbing pressure washing tool diverts a portion of the liquid received under pressure to generate a motive force that moves the wall-climbing pressure washing tool along the vertical surface. The wall-climbing pressure washing tool comprises a pressure head and a telescopic handle. The pressure head is the working element of the wall-climbing pressure washing tool. The pressure head receives the liquid under pressure. The pressure head diverts a portion of the liquid received under pressure to a climbing wheel. The climbing wheel is a motive device that moves the pressure head along the vertical surface. The pressure head transports the balance of the liquid received under pressure to the vertical surface. The telescopic handle is a grip used to manipulate the wall-climbing pressure washing tool. The span of the length of the telescopic handle adjusts as the pressure head moves along the vertical surface.

These together with additional objects, features and advantages of the wall-climbing pressure washing tool will be readily apparent to those of ordinary skill in the art upon reading the following detailed description of the presently preferred, but nonetheless illustrative, embodiments when taken in conjunction with the accompanying drawings.

In this respect, before explaining the current embodiments of the wall-climbing pressure washing tool in detail, it is to be understood that the wall-climbing pressure washing tool is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the wall-climbing pressure washing tool.

It is therefore important that the claims be regarded as including such equivalent construction insofar as they do not depart from the spirit and scope of the wall-climbing pressure washing tool. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
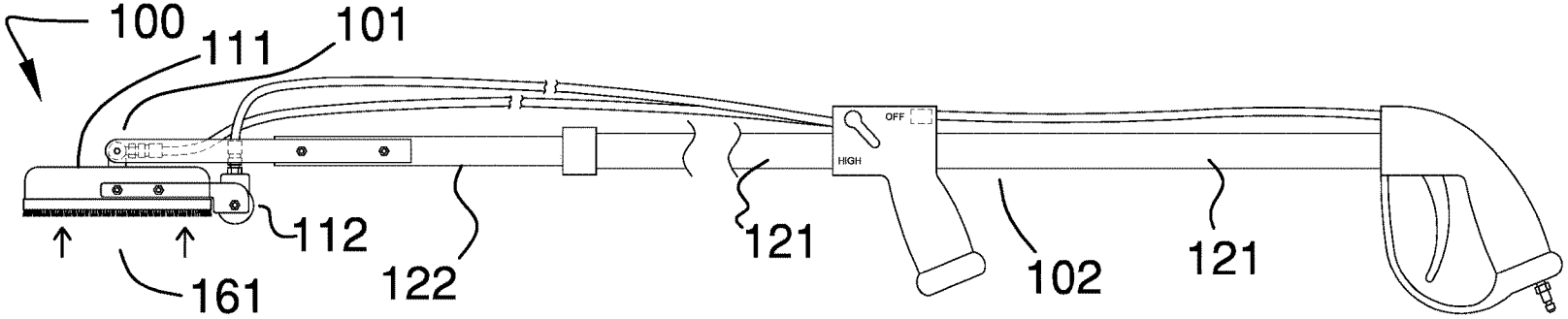
FIG. 1 is a side view of an embodiment of the disclosure.
Figure 2:
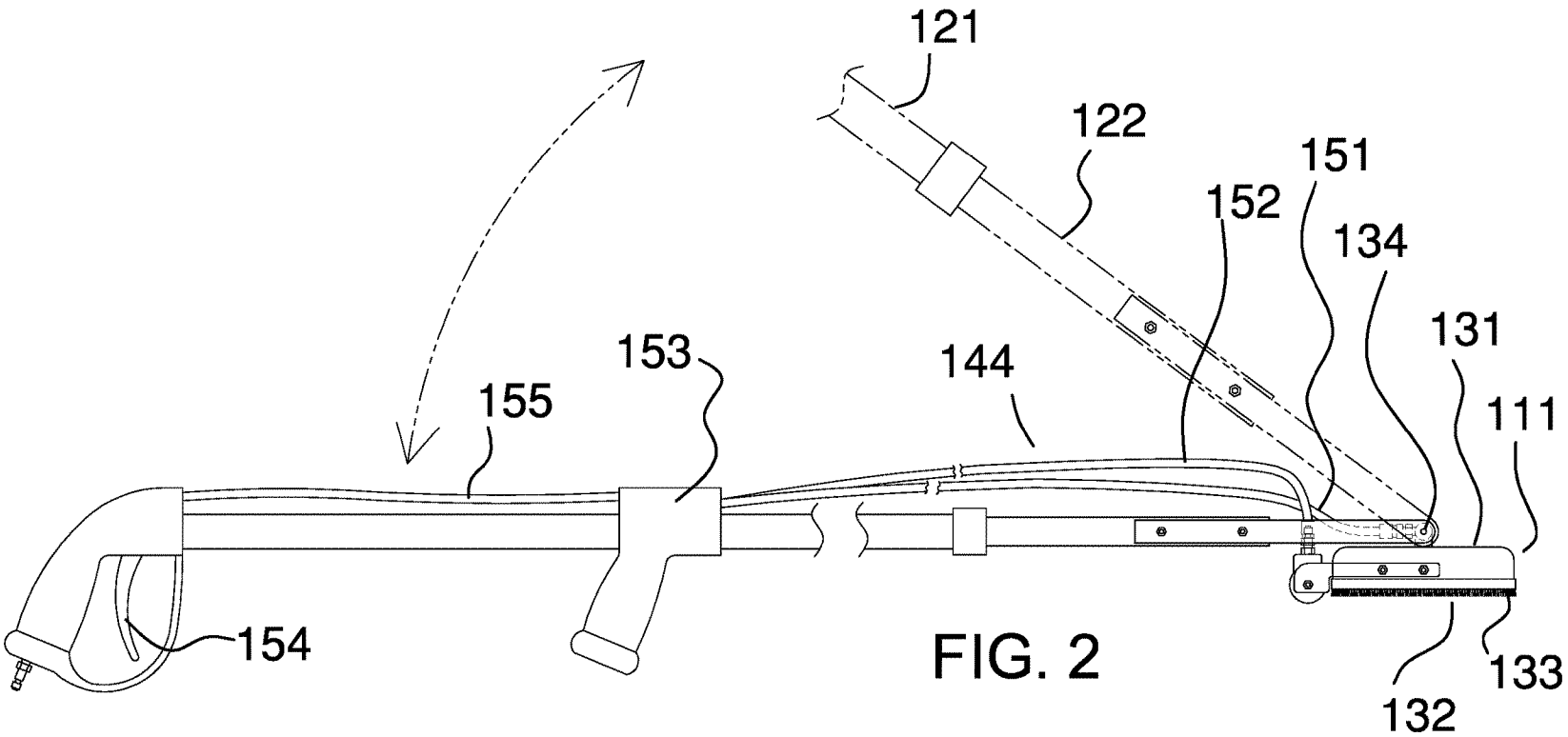
FIG. 2 is a reverse side view of an embodiment of the disclosure.
Figure 3:
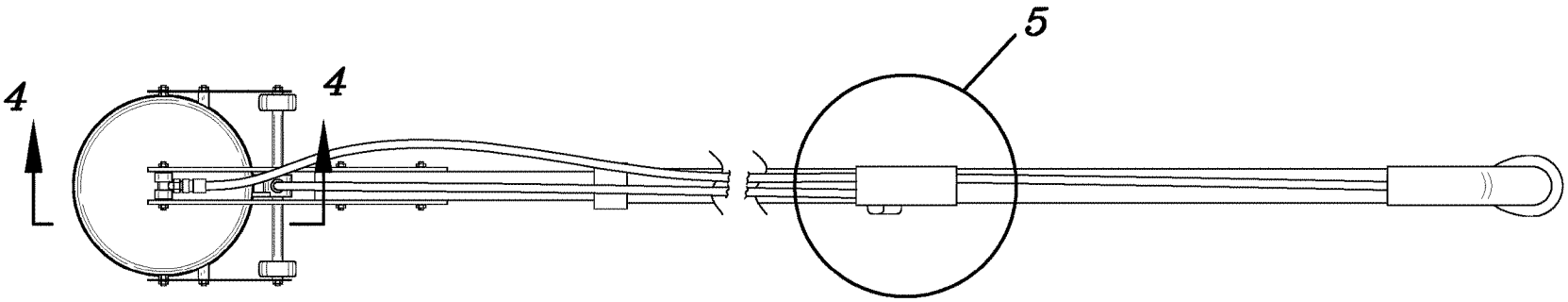
FIG. 3 is a top view of an embodiment of the disclosure.
Figure 4:
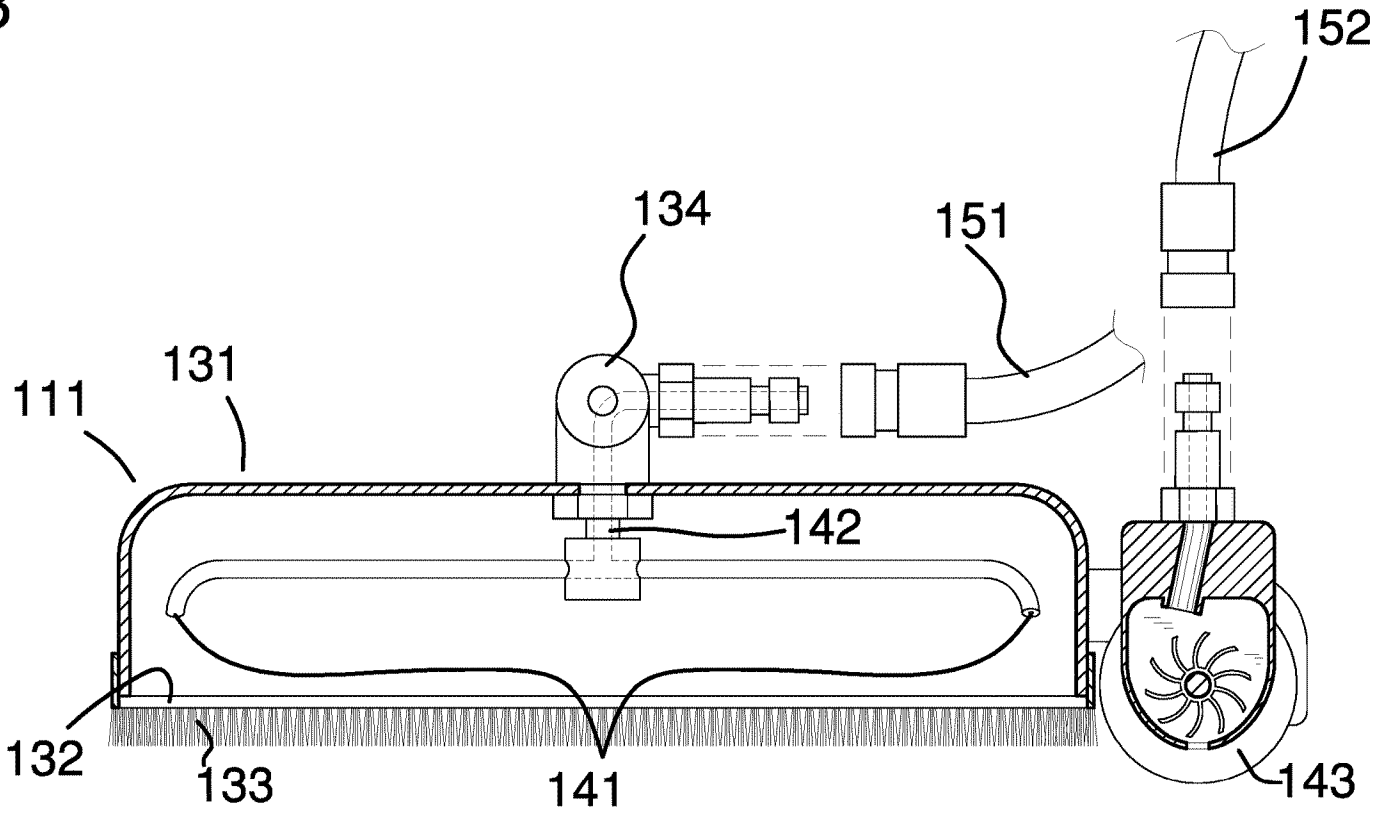
FIG. 4 is a cross-sectional view of an embodiment of the disclosure across 4-4 as shown in FIG. 3.
Figure 5:
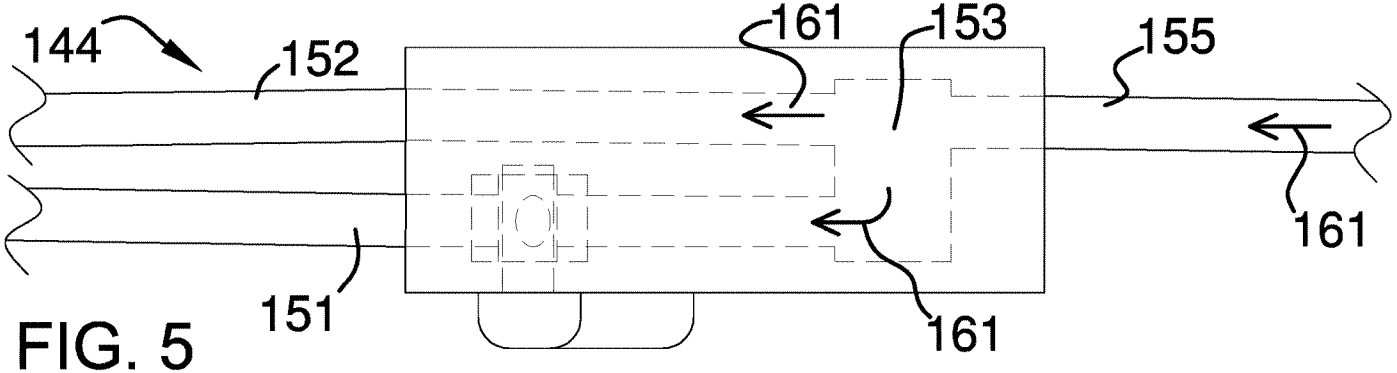
FIG. 5 is a detail view of an embodiment of the disclosure.
Figure 6:
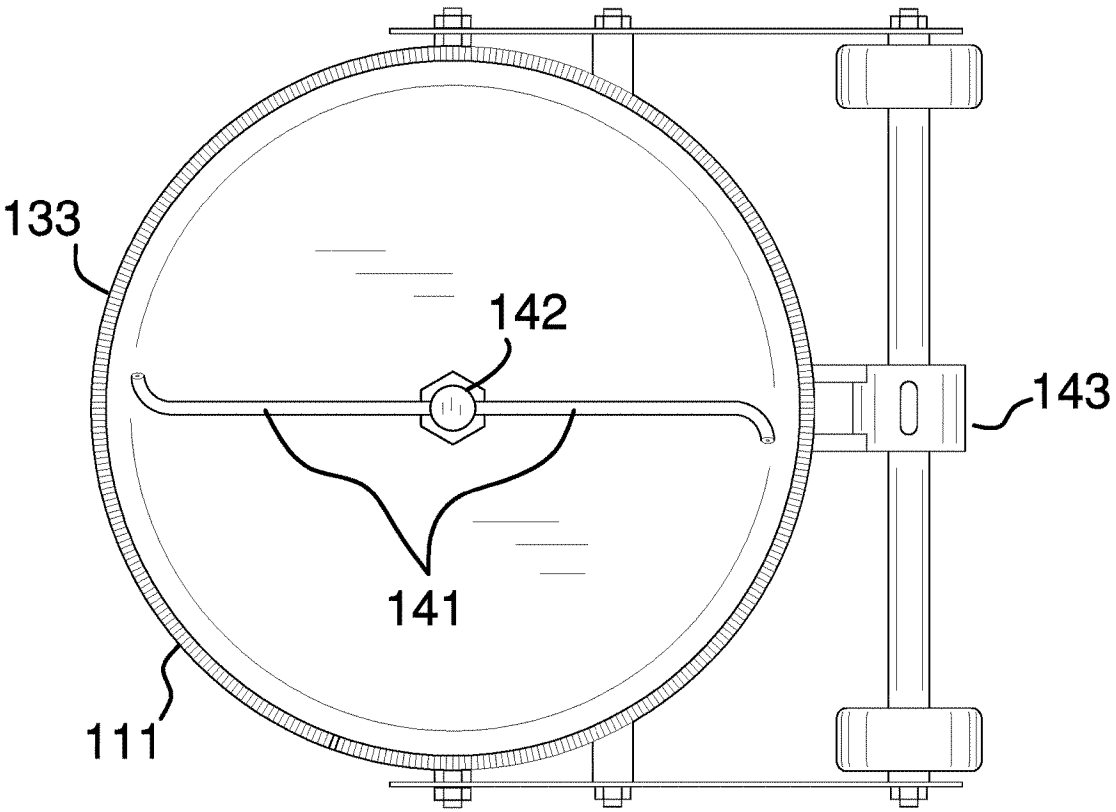
FIG. 6 is a detail view of an embodiment of the disclosure.

Detailed reference will now be made to one or more potential embodiments of the disclosure, which are illustrated in FIGS. 1 through 6.

The wall-climbing pressure washing tool 100 (hereinafter invention) is a hand tool. The invention 100 is a pressure washing device. The invention 100 is configured for use with a vertical surface. The invention 100 transports a liquid received under pressure 161 to the vertical surface. The invention 100 diverts a portion of the liquid received under pressure 161 to generate a motive force that moves the invention 100 along the vertical surface. The liquid received under pressure 161 refers to a liquid selected from the group consisting of: a) water; and, b) a water-based cleaning solution.

The invention 100 comprises a pressure head 101 and a telescopic handle 102. The pressure head 101 is the working element of the invention 100. The pressure head 101 receives the liquid under pressure 161. The pressure head 101 diverts a portion of the liquid received under pressure 161 to a climbing wheel 143. The climbing wheel 143 is a motive device that moves the pressure head 101 along the vertical surface. The pressure head 101 transports the balance of the liquid received under pressure 161 to the vertical surface. The telescopic handle 102 is a grip used to manipulate the invention 100. The span of the length of the telescopic handle 102 adjusts as the pressure head 101 moves along the vertical surface.

The telescopic handle 102 is an extension apparatus. The pressure head 101 attaches to an end of the telescopic handle 102. The telescopic handle 102 is a grip used to manipulate the operation of the pressure head 101. The span of the length of the telescopic handle 102 adjusts as the pressure head 101 moves along the vertical surface targeted for cleaning. The movement of the pressure head 101 provides the motive force required to change the span of the length of the telescopic handle 102.

The telescopic handle 102 further comprises a first arm 121 and a second arm 122. The first arm 121 is a hollow first prism that is further defined with an inner dimension. The second arm 122 is a second prism that is further defined with an outer dimension. The first arm 121 and the second arm 122 are geometrically similar. The outer dimension of the second arm is less than the inner dimension of the first arm 121 such that the second arm 122 inserts into the first arm 121 in a telescopic manner. This telescopic arrangement of the telescopic handle 102 allows the length of the telescopic handle 102 to be adjusted by adjusting the relative position of the second arm 122 within the first arm 121.

The pressure head 101 is the working element of the invention 100. The pressure head 101 discharges the liquid received under pressure 161 directly on to the vertical surface targeted for cleaning. The pressure head 101 is a self-propelled device that moves along the vertical surface targeted for cleaning during the cleaning process. The pressure head 101 comprises a containment pan 111 and a cleaning head structure 112.

The containment pan 111 is a prism-shaped structure. The containment pan 111 is a pan-shaped structure. An end of the prism shape that forms the containment pan 111 is left open such that the containment pan 111 forms the pan shape. The open face of the containment pan 111 is placed against the vertical surface targeted for cleaning during the cleaning process. The containment pan 111 directs the liquid received under pressure 161 towards the vertical surface targeted for cleaning. The containment pan 111 comprises a brush head 133 and a pan pivot 134. The containment pan 111 is further defined with a closed end 131 and an open end 132.

The closed end 131 is the congruent face of the prism shape of the containment pan 111 that is closed. The closed end 131 is distal from the open end 132. The open end 132 is the congruent face of the pan structure of the containment pan 111 that is open. The bulk of the liquid received under pressure 161 discharges from the pressure head 101 through the open end 132.

The brush head 133 is a brush that mounts on the perimeter of the open end 132 of the containment pan 111. The brush head 133 limits the direction of flow of the liquid received under pressure 161 as it is discharged from the pressure head 101. The brush head 133 scrubs the vertical surface targeted for cleaning as the pressure head 101 moves along the vertical surface targeted for cleaning. The use of a brush head 133 is well-known and documented in the building maintenance arts.

The pan pivot 134 is a fastening device. The pan pivot 134 is a hardware item. The pan pivot 134 attaches the containment pan 111 to the second arm 122 of the telescopic handle 102. The pan pivot 134 forms a pivot that allows the containment pan 111 to rotate relative to the center axis of the second arm 122 as the containment pan 111 moves along the vertical surface targeted for cleaning. The use of the pan pivot 134 allows the open end 132 of the containment pan 111 to remain flush to the vertical surface targeted for cleaning as the containment pan 111 moves along the vertical surface targeted for cleaning during the cleaning process.

The cleaning head structure 112 is the cleaning structure of the pressure head 101. The cleaning head structure 112 receives the liquid under pressure 161. The cleaning head structure 112 transports the liquid received under pressure 161 to the vertical surface targeted for cleaning. The cleaning head structure 112 directs as a spray a portion of the liquid received under pressure 161 onto the vertical surface targeted for cleaning. The cleaning head structure 112 diverts a portion of the liquid received under pressure 161 to power a motive device known as a climbing wheel 143. The climbing wheel 143 draws energy from the diverted flow of the liquid received under pressure 161 to move the cleaning head structure 112 along the vertical surface targeted for cleaning. The cleaning head structure 112 comprises a plurality of spray nozzles 141, a spray pivot 142, a climbing wheel 143, and a water feed apparatus 144.

The plurality of spray nozzles 141 is a rotating structure. The plurality of spray nozzles 141 distributes the liquid received under pressure 161. The plurality of spray nozzles 141 is a tubular structure that targets the liquid received under pressure 161 in a spray form onto the vertical surface targeted for cleaning. The pressure of the liquid received under pressure 161 causes the plurality of spray nozzles 141 to rotate such that the liquid received under pressure 161 is evenly distributed on the vertical surface targeted for cleaning. Methods to form a structure that performs the described functions of the plurality of spray nozzles 141 are well-known and documented in the mechanical arts.

The spray pivot 142 is a rotary union. The spray pivot 142 attaches the plurality of spray nozzles 141 to the interior surface of the closed end 131 of the containment pan 111. The spray pivot 142 attaches the plurality of spray nozzles 141 to the containment pan 111 such that the plurality of spray nozzles 141 rotates within the containment pan 111. The spray pivot 142 further transports the liquid received under pressure 161 from the water feed apparatus 144 into the plurality of spray nozzles 141. The pressure of the liquid received under pressure 161 through the spray pivot 142 causes the plurality of spray nozzles 141 and the spray pivot 142 to rotate during use of the invention 100. The design and use of a rotary union for the described function of the spray pivot 142 are well-known and documented in the mechanical arts.

The climbing wheel 143 is a rotating drive structure. The climbing wheel 143 uses the pressure derived from a flow of liquid diverted from the liquid received under pressure 161 to rotate. The climbing wheel 143 turns with sufficient force such that when the open end 132 of the containment pan 111 is placed against the vertical surface targeted for cleaning, the climbing wheel 143 will move the pressure head 101 along the vertical surface targeted for cleaning. The movement of the climbing wheel 143 of the cleaning head structure 112 changes the relative position of the second arm 122 within the first arm 121.

The water feed apparatus 144 is a mechanical apparatus. The water feed apparatus 144 receives the liquid under pressure 161 from an external source. The water feed apparatus 144 distributes the liquid received under pressure 161 to the plurality of spray nozzles 141 through the spray pivot 142. The water feed apparatus 144 distributes the liquid received under pressure 161 to the climbing wheel 143. The water feed apparatus 144 comprises a first feed tube 151, a second feed tube 152, a manifold 153, a trigger valve 154, and a master feed 155.

The first feed tube 151 is a hose. The first feed tube 151 transports the liquid received under pressure 161 from the manifold 153 to the spray pivot 142 of the cleaning head structure 112. The second feed tube 152 is a hose. The second feed tube 152 transports the liquid received under pressure 161 from the manifold 153 to the climbing wheel 143.

The manifold 153 is a tubular network. The manifold 153 receives the liquid under pressure 161 from the master feed 155. The manifold 153 distributes the liquid received under pressure 161 to the first feed tube 151 and the second feed tube 152.

The trigger valve 154 is a lever operated valve. The trigger valve 154 controls the flow of the liquid received under pressure 161 from the external source into the master feed 155. The trigger valve 154 attaches to the first arm 121 of the telescopic handle 102.

The master feed 155 is a hose. The master feed 155 transports the liquid received under pressure 161 from the trigger valve 154 to the manifold 153.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bristle: As used in this disclosure, a bristle is a short coarse stiff hair or hair-like object.

Brush: As used in this disclosure, a brush is a device comprising a plurality of bristles set into a handle or a base that is used for grooming, sweeping, smoothing, scrubbing, or painting.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. Specifically, the sum of the surface areas of two ends of the prism-shaped object that forms the disk is greater than the surface area of the lateral face of the prism-shaped object that forms the disk. In this disclosure, the ends of the prism-shaped structure that forms the disk are referred to as the faces of the disk.

Extension Apparatus: As used in this disclosure, an extension apparatus is a mechanical structure that is used to extend the span of the distance between any two objects or the reach of a first object towards a second object.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Flush: As used in this disclosure, the term flush is used to describe the alignment of a first surface and a second surface on a single plane.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Grip: As used in this disclosure, a grip is an accommodation formed on or within an object that allows the object to be grasped or manipulated by a hand.

Handle: As used in this disclosure, a handle is an object by which a tool, object, or door is held or manipulated with the hand.

Hand Tool: As used in this disclosure, a hand tool refers to a tool that is small and light enough to allow a person to hold the tool during use.

Hardware: As used in this disclosure, refers to one or more incidental objects: 1) that are readily and commercially available; and, 2) that are associated with the installation, operation or maintenance of a primary object. Always use incidental.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Hose: As used in this disclosure, a hose is a flexible hollow tube that is used for transporting liquids and gases. When referring to a hose in this disclosure, the terms inner diameter and outer diameter are used as they would be used by those skilled in the plumbing arts.

Incidental: As used in this disclosure, incidental refers to a second object that is associated with a first object but that: 1) does not significantly affect the characteristics of the first object; and, 2) the function of which can be readily replaced by or substituted with a third object.

Inner Dimension: As used in this disclosure, the term inner dimension describes the span from a first inside or interior surface of a container to a second inside or interior surface of a container. The term is used in much the same way that a plumber would refer to the inner diameter of a pipe.

Lever: As used in this disclosure, a lever is a simple machine that comprises a shaft that rotates around a fulcrum or pivot point.

Liquid: As used in this disclosure, a liquid refers to a state (phase) of matter that is fluid and that maintains, for a given pressure, a fixed volume that is independent of the volume of the container.

Nozzle: As used in this disclosure, a nozzle is a device that receives fluid under pressure and releases the fluid in a controlled manner into an environment.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) an end of the prism structure that forms the pan; and, b) a lateral face of the prism structure that forms the pan.

Pivot: As used in this disclosure, a pivot is a rod or shaft around which an object rotates or swings.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rotary Union: As used in this disclosure, a rotary union is a commercially available plumbing fitting that allows a fluid from a stationary source to be pumped into a rotating structure.

Spray: As used in this disclosure, a spray is a plurality of liquid drops dispersed in a gas.

Spray Nozzle: As used in this disclosure, a spray nozzle is a device that receives liquid under pressure and disperses that liquid into the atmosphere as a spray.

Telescopic: As used in this disclosure, telescopic is an adjective that describes an object made of sections that fit or slide into each other such that the object can be made longer or shorter by adjusting the relative positions of the sections.

Tool: As used in this disclosure, a tool is a device, an apparatus, or an instrument that is used to carry out an activity, operation, or procedure.

Trigger: As used in this disclosure, a trigger is a lever that operates in conjunction with a spring or similar device such that: 1) the lever is used to activate a mechanism; and 2) the spring or similar device returns the lever to its original position after the mechanism has been activated.

Tube: As used in this disclosure, a tube is a hollow prism-shaped device formed with two open ends. The tube is used for transporting liquids and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

Valve: As used in this disclosure, a valve is a device that is used to control the flow of a fluid (gas or liquid) through a pipe.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

Wall: As used in this disclosure, a wall is a vertical surface of a chamber.

Working Element: As used in this disclosure, the working element of a tool is the physical element on the tool that performs the actual activity, operation, or procedure the tool is designed to perform. For example, the cutting edge of a blade is the working element of a knife. With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A pressure washing device comprising:

a pressure head and a telescopic handle;

wherein the pressure head is the working element of the pressure washing device;

wherein the pressure head attaches to the telescopic handle;

wherein the pressure washing device is a hand tool;

wherein the pressure washing device is configured for use with a vertical surface;

wherein the pressure washing device transports a liquid received under pressure to the vertical surface;

wherein the pressure head comprises a containment pan and a cleaning head structure;

wherein the containment pan is further defined with a closed end and an open end;

wherein the cleaning head structure comprises a plurality of spray nozzles, a spray pivot, and a climbing wheel;

wherein a water feed apparatus is fluidically interconnected to the plurality of spray nozzles, the spray pivot, and the climbing wheel;

wherein the telescopic handle further comprises a first arm and a second arm;

wherein the water feed apparatus is provided on the first arm;

wherein the pressure head diverts a portion of the liquid received under pressure to the climbing wheel;

wherein the climbing wheel uses the pressure derived from a flow of liquid diverted from the liquid received under pressure to rotate;

wherein the climbing wheel draws energy from the diverted flow of the liquid received under pressure to move the cleaning head structure along the vertical surface targeted for cleaning;

wherein the climbing wheel turns with sufficient force such that the climbing wheel will move the pressure head along the vertical surface targeted for cleaning;

wherein the movement of the climbing wheel of the cleaning head structure changes the relative position of the second arm within the first arm.

2. The pressure washing device according to claim 1 wherein the pressure head is the working element of the pressure washing device;

wherein the pressure head receives the liquid under pressure;

wherein the pressure head discharges the liquid received under pressure directly on to the vertical surface targeted for cleaning;

wherein the pressure head is a self-propelled device that moves along the vertical surface targeted for cleaning;

wherein the pressure washing device diverts a portion of the liquid received under pressure to generate a motive force that moves the pressure washing device along the vertical surface;

wherein the pressure head transports the balance of the liquid received under pressure to the vertical surface.

3. The pressure washing device according to claim 2 wherein the telescopic handle is an extension apparatus;

wherein the pressure head attaches to an end of the telescopic handle;

wherein the telescopic handle comprises a grip;

wherein the telescopic handle manipulates the pressure washing device.

4. The pressure washing device according to claim 3 wherein the first arm is a hollow first prism that is further defined with an inner dimension;

wherein the second arm is a second prism that is further defined with an outer dimension;

wherein the first arm and the second arm are geometrically similar;

wherein the outer dimension of the second arm is less than the inner dimension of the first arm such that the second arm inserts into the first arm in a telescopic manner;

wherein the span of the length of the telescopic handle adjusts by adjusting the relative position of the second arm within the first arm.

5. The pressure washing device according to claim 4 wherein the containment pan is a prism-shaped structure;

wherein the containment pan is a pan-shaped structure;

wherein a congruent face of the prism shape that forms the containment pan is the open end of the containment pan forms the pan shape;

wherein the open end of the containment pan is placed against the vertical surface targeted for cleaning;

wherein the containment pan directs the liquid received under pressure towards the vertical surface targeted for cleaning;

wherein the closed end is the congruent face of the prism shape of the containment pan that is closed;

wherein the closed end is distal from the open end.

6. The pressure washing device according to claim 5 wherein the cleaning head structure is the cleaning structure of the pressure head;

wherein the cleaning head structure receives the liquid under pressure;

wherein the cleaning head structure transports the liquid received under pressure to the vertical surface targeted for cleaning;

wherein the cleaning head structure directs as a spray a portion of the liquid received under pressure onto the vertical surface targeted for cleaning.

7. The pressure washing device according to claim 6 wherein the containment pan comprises a brush head and a pan pivot;

wherein the brush head is a brush that mounts on the perimeter of the open end of the containment pan;

wherein the pan pivot is a fastening device;

wherein the pan pivot attaches the containment pan to the second arm of the telescopic handle;

wherein the pan pivot forms a pivot that allows the containment pan to rotate relative to the center axis of the second arm as the containment pan moves along the vertical surface targeted for cleaning.

8. The pressure washing device according to claim 7 wherein the plurality of spray nozzles is a rotating structure;

wherein the plurality of spray nozzles distributes the liquid received under pressure;

wherein the plurality of spray nozzles is a tubular structure that targets the liquid received under pressure in a spray form onto the vertical surface targeted for cleaning.

9. The pressure washing device according to claim 8 wherein the pressure of the liquid received under pressure causes the plurality of spray nozzles to rotate such that the liquid received under pressure is evenly distributed on the vertical surface targeted for cleaning.

10. The pressure washing device according to claim 9 wherein the spray pivot is a rotary union.

11. The pressure washing device according to claim 10 wherein the spray pivot attaches the plurality of spray nozzles to the interior surface of the closed end of the containment pan;

wherein the spray pivot attaches the plurality of spray nozzles to the containment pan such that the plurality of spray nozzles rotates within the containment pan.

12. The pressure washing device according to claim 11 wherein the spray pivot further transports the liquid received under pressure from the water feed apparatus into the plurality of spray nozzles;

wherein the pressure of the liquid received under pressure through the spray pivot causes the plurality of spray nozzles and the spray pivot to rotate during use of the pressure washing device.

13. The pressure washing device according to claim 12 wherein the climbing wheel is a rotating drive structure;

wherein the climbing wheel is the motive device that moves the pressure head along the vertical surface.

14. The pressure washing device according to claim 13 wherein the water feed apparatus is a mechanical apparatus;

wherein the water feed apparatus receives the liquid under pressure from an external source;

wherein the water feed apparatus distributes the liquid received under pressure to the plurality of spray nozzles through the spray pivot;

wherein the water feed apparatus distributes the liquid received under pressure to the climbing wheel.

15. The pressure washing device according to claim 14 wherein the water feed apparatus comprises a first feed tube, a second feed tube, a manifold, a trigger valve, and a master feed;

wherein the first feed tube, the second feed tube, the manifold, the trigger valve, and the master feed are fluidically interconnected.

16. The pressure washing device according to claim 15 wherein the first feed tube is a hose;

wherein the second feed tube is a hose;

wherein the manifold is a tubular network;

wherein the trigger valve is a lever operated valve;

wherein the trigger valve attaches to the first arm of the telescopic handle;

wherein the master feed is a hose.

17. The pressure washing device according to claim 16 wherein the first feed tube transports the liquid received under pressure from the manifold to the spray pivot of the cleaning head structure;

wherein the second feed tube transports the liquid received under pressure from the manifold to the climbing wheel;

wherein the manifold receives the liquid under pressure from the master feed;

wherein the manifold distributes the liquid received under pressure to the first feed tube and the second feed tube;

wherein the trigger valve controls the flow of the liquid received under pressure from the external source into the master feed;

wherein the master feed transports the liquid received under pressure from the trigger valve to the manifold;

wherein the liquid received under pressure is a liquid selected from the group consisting of: a) water; and, b) a water-based cleaning solution.

* * * * *